US005876294A

United States Patent [19]

Yamagishi et al.

[11] Patent Number: 5,876,294

[45] Date of Patent: Mar. 2, 1999

[54] THREE-PIECE SOLID GOLF BALL

[75] Inventors: Hisashi Yamagishi; Hiroshi Higuchi; Junji Hayashi, all of Chichibu; Nobuhiko Matsumura; Kunitoshi Ishihara, both of Izumiohtsu, all of Japan

[73] Assignee: Bridgestone Sports Co., Ltd., Tokyo, Japan

[21] Appl. No.: 976,092

[22] Filed: Nov. 21, 1997

[30] Foreign Application Priority Data

Nov. 25, 1996 [JP] Japan ..... 8-329230

[51] Int. Cl.[6] ..... A63B 37/12; A63B 37/06; A63B 37/14

[52] U.S. Cl. ..... 473/374; 473/373; 473/384; 473/385

[58] Field of Search ..... 473/373, 374, 473/384, 385

[56] References Cited

U.S. PATENT DOCUMENTS 5,730,664 3/1998 Asakura et al. ..... 473/373

5,779,563 7/1998 Yamagishi et al. ..... 473/373 X

FOREIGN PATENT DOCUMENTS

| | | |
|---|---|---|
| A92372 | 6/1983 | Japan . |
| B4110 | 1/1993 | Japan . |
| A319830 | 11/1994 | Japan . |
| A343718 | 12/1994 | Japan . |
| A24085 | 1/1995 | Japan . |
| A194735 | 8/1995 | Japan . |
| A194736 | 8/1995 | Japan . |

*Primary Examiner*—George J. Marlo
*Attorney, Agent, or Firm*—Sughrue, Mion, Zinn, Macpeak & Seas, PLLC

[57] ABSTRACT

In a three-piece solid golf ball of the three layer structure consisting of a solid core, an intermediate layer, and a cover, the specific gravity of the solid core is lower than the specific gravity of the intermediate layer and the cover, and the Shore D hardness of the intermediate layer is higher than the Shore D hardness of the cover. The ball as a whole has an inertia moment of at least 83 g-cm$^2$. The desirable properties of spin, feel, control and distance are obtained.

7 Claims, 2 Drawing Sheets

THREE-PIECE SOLID GOLF BALL

BACKGROUND OF THE INVENTION

1. Field of the Invention

This invention relates to a three-piece solid golf ball of the three layer structure consisting of a solid core, an intermediate layer, and a cover, and having the desirable properties of spin, feel, control and distance.

2. Prior Art

The golf balls which have been commercially available for decades include solid golf balls having a solid core enclosed with a cover of synthetic rubber and wound golf balls having a wound core (obtained by winding thread rubber around a liquid center) enclosed with a cover of natural rubber, typically balata rubber and synthetic rubber. While solid golf balls having a cover of synthetic rubber featuring added distance and durability enjoy a widespread use, many professional golfers still favor a wound golf ball having a cover of balata rubber, which is simply referred to as wound balata ball, hereinafter.

The reason is that the wound balata ball has superior hitting feel and spin control to the remaining golf balls. Although professional golfers seek for a golf ball offering a longer flight distance, they seldom consider the distance as the first condition for ball selection, but place more stress on hitting feel and spin control.

In order to produce a golf ball which not only complies with such professional golfers' needs, but is also suited for ordinary golfers' play, various proposals have been made on solid golf balls so as to impart the desirable properties of distance, feel and spin control. For example, JP-B 4110/1993 and JP-A 319830/1994 disclose a two-piece solid golf ball which has a good feel and is improved in control by adjusting spin property. Also proposed were three-piece solid golf balls of the three layer structure consisting of a solid core, an intermediate layer, and a cover as disclosed in JP-A 92372/1983, 24085/1995, 343718/1994, 194735/1995, 194736/1995, and 239068/1997. There were proposed many three-piece solid golf balls which are designed so as to improve feel and control.

Despite such improvements, many players still use the wound balata ball because the solid golf balls proposed thus far have not reached the feel and spin control levels above which these players are satisfied. In particular, the spin control is one of the most important factors for the performance of golf balls. It is thus strongly desired to improve the spin control of solid golf balls without detracting from the remaining properties of distance and feel.

The spin property of solid golf balls can be improved to some extent by making the cover soft. The soft cover, however, lowers the resiliency of the ball, resulting in a reduced flight distance. That is, the superior flight performance characteristic of solid golf balls is lost.

In general, golf clubs for gaining a distance such as a driver and long irons have a small loft angle whereas golf clubs for aiming the pin or target such as short irons have a large loft angle and are designed so as to stop the ball at the desired position rather than distance. When a golf ball is hit with a golf club, the ball receives both a force acting perpendicular to the club face and a force acting parallel to the club face depending on the loft angle. The perpendicular force contributes to deriving resiliency from the ball whereas the parallel force contributes to spinning the ball. On shots with driver and long iron clubs having a small loft angle, the perpendicular force becomes greater while the parallel force is relatively weak. These clubs are designed for gaining distance by imparting an appropriately suppressed spin rate, a relatively low trajectory, and greater resiliency. Inversely, on shots with short iron clubs having a large loft angle, the parallel force becomes greater while the perpendicular force is relatively weak. These clubs are designed so as to give a greater spin to the ball rather than distance.

Therefore, simply increasing a spin rate is not sufficient. It is desired that upon shots with driver and long iron clubs, a flight distance is ensured by an appropriately suppressed spin rate which restrains flight distance shortage and wind influence which are otherwise caused by the lofting of the ball by spin (to follow a higher trajectory than necessity), and that upon shots with short iron clubs for aiming the target, the ease of control is ensured by a sufficient spin rate leading to a relatively high trajectory and a reduced run or roll after ball landing. Sufficient in-flight retention of the spin rate given by a strike is also important for the flight distance to be increased and for the spin control to be effective.

Another problem arises upon putting. Unlike ordinary shots to drive the ball into flight, putting is to roll the ball on the green so that the ball may readily change its path by angulation on the green. Since putting directly aims the hole, successful putting makes a good score and vice versa. What is desired in this regard is a golf ball which rolls well and goes straight upon putting without being affected by subtle angulation.

SUMMARY OF THE INVENTION

Therefore, an object of the present invention is to provide a novel and improved solid golf ball which receives an appropriate spin from a particular type of club selected and offers a soft feel, easy control, and good rolling without detracting from the flight distance and durability characteristic of solid golf balls.

According to the invention, there is provided a three-piece solid golf ball of the three layer structure consisting of a solid core, an intermediate layer, and a cover. The specific gravity of the solid core is lower than the specific gravity of the intermediate layer and the cover. The Shore D hardness of the intermediate layer is higher than the Shore D hardness of the cover. The ball as a whole has an inertia moment of at least 83 g-cm$^2$. With these requirements met, there is obtained a high performance golf ball which offers a soft feel and receives an appropriate spin from any type of club without detracting from the flight distance and durability characteristic of solid golf balls and hence, is improved in distance, durability, feel, and spin control. In addition, this golf ball has good rolling in that it rolls straight upon putting without being affected by subtle angulation on the green.

More particularly, the golf ball of the invention is improved in spin control by using the soft cover. The use of the high specific gravity cover and the high specific gravity intermediate layer allows the specific gravity of the core to be reduced, which allows the amount of filler used in the core to be reduced and the core to have a higher fraction of rubber. This permits the core to be increased in resiliency. The highly resilient core and the hard intermediate layer are more than to compensate for a resiliency loss of the soft cover, achieving satisfactory resiliency as a whole. The core having a high fraction of rubber can be formed soft while maintaining good reaction. The soft structure of the soft core combined with the soft cover is effective for appropriately suppressing a spin rate upon hitting with driver and long iron clubs having a small loft angle, so that the ball may not be highly lofted, but follow an appropriate flat trajectory without being affected by the wind. The flat trajectory combined with the above-mentioned good resiliency results in a satisfactory flight distance. Furthermore, since the golf ball of the invention has a relatively great inertia moment of at least 83 g-cm$^2$, the ball can retain the spin in flight. Upon driver and long iron shots, the spin rate is not so reduced until the ball nearly lands, and the trajectory is thus extended even at the last stage, resulting in an increased flight distance. Upon short iron shots, spin control is fully exerted in that the run after landing is reduced, and rolling property is good in that the ball will roll straight without being affected by subtle angulation on the green.

BRIEF DESCRIPTION OF THE DRAWINGS

These and other objects, features and advantages of the present invention will be apparent with reference to the following description and drawings.

DETAILED DESCRIPTION OF THE INVENTION

Figure 1:
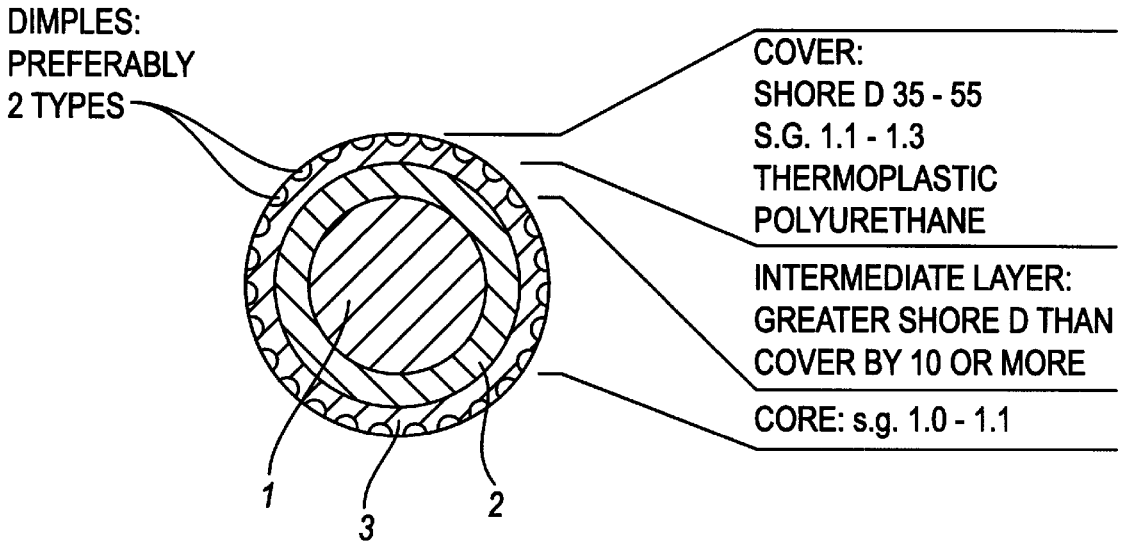
FIG. 1 is a schematic cross-sectional view of a three-piece solid golf ball according to one embodiment of the invention.

Referring to FIG. 1, a three-piece solid golf ball according to the invention is illustrated as comprising a solid core 1, an intermediate layer 2, and a cover 3 disposed in a concentric fashion.

The solid core 1 constituting the center of the golf ball has a specific gravity which is lower than the specific gravity of the intermediate layer 2 and the cover 3. The solid core 1 is preferably adjusted to a specific gravity of 1.0 to 1.1, especially 1.02 to 1.10 though not limited thereto. A core with a specific gravity of less than 1.0 would fail to ensure hardness and resiliency whereas a core with a specific gravity of more than 1.1 would require a higher content of filler in the core-forming rubber composition, which would invite a resiliency drop due to a relatively lower rubber fraction.

Also, the solid core 1 is preferably adjusted to a hardness expressed by a distortion of at least 2.5 mm, especially at least 2.8 mm under a load of 100 kg. With a distortion of less than 2.5 mm under a load of 100 kg, the ball would receive more spin to loft higher upon driver and long iron shots and give a hard feel upon such shots.

Typically, the solid core 1 has a diameter of 30 to 39 mm, especially 33 to 38 mm though not limited thereto. A diameter of less than 30 mm would lead to a shortage of resiliency whereas a diameter of more than 39 mm would require the intermediate layer 2 and the cover 3 to be thin, inviting the inconvenience of poor durability.

The solid core may be formed of a well-known rubber composition comprising a base rubber, a co-crosslinking agent, and a peroxide by well known methods, for example, molding it at elevated temperature under pressure. The base rubber used herein may be polybutadiene rubber or a mixture of polybutadiene rubber and polyisoprene rubber, which are commonly used in conventional solid golf balls. The use of 1,4-polybutadiene rubber having at least 90% of a cis structure is preferred for the high restitution purpose. The co-crosslinking agent used herein may be selected from conventional ones, for example, zinc and magnesium salts of unsaturated fatty acids such as methacrylic acid and acrylic acid and esters of unsaturated fatty acids such as trimethylpropane trimethacrylate, which are used in conventional solid golf balls. Zinc acrylate is especially preferred for the high restitution purpose. The co-crosslinking agent is preferably used in an amount of about 15 to 35 parts by weight per 100 parts by weight of the base rubber. Many peroxides are useful although dicumyl peroxide or a mixture of dicumyl peroxide and 1,1-bis(t-butylperoxy)-3,3,5-trimethylcyclohexane is preferred. The peroxide is preferably blended in an amount of about 0.5 to 1 part by weight per 100 parts by weight of the base rubber.

In the rubber composition, there may be blended other conventional additives such as antioxidants and fillers for adjusting specific gravity, e.g., zinc oxide and barium sulfate, if desired. Since the solid core should have a lower specific gravity than the intermediate layer and the cover according to the invention, typically a specific gravity of 1.0 to 1.1, the amount of the specific gravity-adjusting filler used can be reduced and the rubber fraction of the rubber composition can be relatively increased. This enables to increase the resiliency of the core or to produce a soft core without detracting from resiliency. The amount of the specific gravity-adjusting filler blended is 0 to 15 parts, especially 0 to 10 parts by weight per 100 parts by weight of the base rubber though not limited thereto.

The intermediate layer 2 has a higher specific gravity than the core 1 and a higher Shore D hardness than the cover 3. Preferably the intermediate layer 2 has a specific gravity of 1.1 to 1.6, especially 1.1 to 1.5 and a Shore D hardness of 55 to 70, more preferably 58 to 68, especially 60 to 66, though not limited thereto. The intermediate layer 2 is formed as a relatively hard layer in order to compensate for a resiliency loss of the soft cover 3 and as a relatively high specific gravity layer in order to allow the core 1 to have a lower specific gravity. If the intermediate layer has a too low Shore D hardness, the ball would become less resilient and travel a shorter distance. If the intermediate layer has a too low specific gravity, it would become difficult to use a low specific gravity core.

The intermediate layer 2 preferably has a gage of 1 to 3.5 mm, especially 1 to 3 mm though not limited thereto.

Since the intermediate layer 2 plays the role of compensating for a resiliency loss of the soft cover 3 as mentioned above, it is formed of a relatively hard, resilient material. Though not critical, useful materials are ionomer resins such as Himilan 1706 and 1605 (Mitsui duPont Polychemical K.K.) and Surlyn (E.I. duPont de Nemours Co.). Preferably, Himilan 1706 and Himilan 1605 are used alone or as a 1/1 mixture. In the intermediate layer, an inorganic filler such as zinc oxide and barium sulfate may be added as a weight adjusting agent to the ionomer resin for adjusting the specific gravity. Also useful are high specific gravity fillers including powder metals and metal oxides such as tungsten, molybdenum, lead, lead oxide, and copper. Additives such as titanium dioxide pigment may also be added.

The cover 3 has a higher specific gravity than the core and a lower Shore D hardness than the intermediate layer 2. Preferably the cover 3 has a specific gravity of 1.1 to 1.3, especially 1.12 to 1.28 and a Shore D hardness of 35 to 55, especially 40 to 53, though not limited thereto. The cover 3 is formed as a relatively soft layer in order to improve spin property and as a relatively high specific gravity layer in order to allow the core 1 to have a lower specific gravity. If the cover has a too high Shore D hardness, the spin property would be deteriorated, that is, spin control be lost. If the cover has a too low specific gravity, it would become difficult to use a low specific gravity core.

The cover 3 preferably has a gage of 1 to 3 mm, especially 1.2 to 2.5 mm though not limited thereto.

The cover 3 may be formed of well-known materials. The base component may be selected from ionomer resins, thermoplastic polyurethane elastomers, polyester elastomers, and polyamide elastomers alone or in admixture with a urethane resin, ethylene-vinyl acetate copolymer, or the like. In the practice of the invention, thermoplastic polyurethane elastomers are preferred because they are soft and scuff resistant. It is especially preferred to use thermoplastic polyurethane elastomers alone. Such a thermoplastic polyurethane elastomer is commercially available under the trade name of Pandex by Dai-Nihon Ink Chemical Industry K.K., for example.

As mentioned above, the cover 3 is formed to a lower Shore D hardness than the intermediate layer 2. Although the difference in hardness between the intermediate layer 2 and the cover 3 is not critical, a difference of at least 10 degrees, especially 12 to 30 degrees on Shore D scale is preferred. With a hardness difference of less than 10 degrees, both spin property and resiliency would not be readily satisfied.

The three-piece solid golf ball of the three layer structure consisting of a solid core, an intermediate layer, and a cover as defined above is adjusted to an inertia moment of at least 83 g-cm$^2$ as a whole.

The optimum range of inertia moment varies with a cover hardness. The inertia moment should be greater for a harder cover, but need not be so greater for a softer cover. This is because a soft cover is susceptible to spin due to the increased friction upon impact and inversely, a hard cover is unsusceptible to spin due to the reduced friction upon impact. A ball with a hard cover is launched at a low spin rate, which means that the spin would quickly attenuate and the ball stall on fall if the inertia moment is less. Inversely, a ball with a soft cover is launched at a high spin rate, which means that the spin would attenuate slowly and the ball loft higher due to more than necessity spin in flight if the inertia moment is great. Either case has a tendency of reducing the flight distance.

Accordingly, the golf ball of the invention, which is constructed such that the soft structure of the soft core combined with the soft cover may appropriately suppress a spin rate upon hitting with driver and long iron clubs, should have a greater inertia moment in order that the ball retain the spin in flight so that an appropriate spin rate may be maintained until nearly landing and the trajectory be extended even at the last stage, resulting in an increased flight distance. Specifically, the golf ball has an inertia moment of at least 83 g-cm$^2$, preferably 83.5 to 90 g-cm$^2$. With an inertia moment of less than 83 g-cm$^2$, the flight distance is short because of insufficient spin retention and a non-extending trajectory.

The increased inertia moment has the additional advantage of improving the ball rolling on the green upon putting. The ball will roll straight without being affected by subtle angulation on the green.

It is understood that the inertia moment is calculated from the diameter and specific gravity of the respective layers. It can be determined from the following equation based on the assumption that the ball is a sphere. The specific gravity of the cover layer is a phantom cover specific gravity of a phantom cover layer regarded free of dimples, as calculated from an actual cover weight, which is lower than an actual cover specific gravity.

$$MI = A \times \{(a-b) \times m^5 + (b-c) \times n^5 + c \times p^5\}$$

MI: inertia moment (g-cm$^2$)
A: constant, $\pi/5880000$
a: core specific gravity
b: intermediate layer specific gravity
c: phantom cover specific gravity
m: core diameter (mm)
n: intermediate layer diameter (mm)
p: ball diameter (mm)

The golf ball of the invention wherein the specific gravity and hardness of the solid core, intermediate layer and cover are adjusted optimum and the inertia moment of the ball consisting of these three layers is adjusted optimum has the following advantages. Upon shot with a driver or long iron, good resiliency, a not-lofting trajectory due to an appropriately suppressed spin rate, and a long-lasting trajectory due to good spin retention ensure an increased flight distance. Upon shot with a short iron or pitching wedge, the ball is well controllable in that it stops as desired due to spin property. This permits the player to aim the pin dead. Upon putting on the green, good rolling property ensures that the ball rolls straight without being affected by angulation. Upon any shot and putting, a soft pleasant feel is obtained. The player can take advantage of the ball at any situation in a round.

As is usually the case, the golf ball of the invention is formed with a plurality of dimples in its surface. The dimpled ball of the invention should preferably meet several parameters associated with dimples though such parameters are not critical. The parameters considered herein are a percent dimple area, a dimple area index Dst, and a percent dimple volume Vr. It is assumed that the golf ball is completely spherical, that is, a phantom sphere defining a phantom spherical surface.

First, the percent dimple area is the total of the surface areas on the phantom spherical surface circumscribed by the edge of individual dimples divided by the overall surface area of the phantom spherical surface. The percent dimple area should preferably be at least 63%, more preferably 65 to 90%, most preferably 70 to 85%.

Secondly, provided that the number of types of dimples formed in the ball surface is n wherein n≧2, preferably n=2 to 6, more preferably n=3 to 5, and the respective types of dimples have a diameter Dmk, a maximum depth Dpk, and a number Nk wherein k=1, 2, 3, . . . , n, the golf ball of the invention prefers that an index Dst of overall dimple surface area given by the following equation (1) is at least 4, more preferably from 4 to 8.

$$Dst = \frac{n \sum_{k=1}^{n} [(Dmk^2 + Dpk^2)\, x V_0 kx Nk]}{4R^2} \quad (1)$$

Note that R is a ball radius, Nk is the number of dimples k, and $V_0$ is the volume of one dimple space below a plane circumscribed by the dimple edge divided by the volume of a cylinder whose bottom is the plane and whose height is the maximum depth of the dimple from the bottom. The index Dst of overall dimple surface area is useful in optimizing various dimple parameters so as to allow the golf ball of the invention to travel a further distance. When the index Dst of overall dimple surface area is equal to or greater than 4, the aerodynamics (flight distance and flight-in-wind) of the golf ball are further enhanced.

Figure 2:
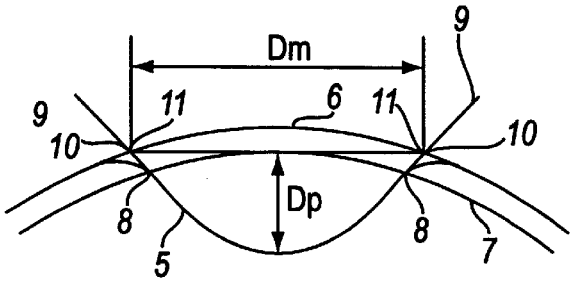
FIG. 2 is a schematic cross-sectional view of a dimple illustrating how to calculate $V_0$.
Figure 3:
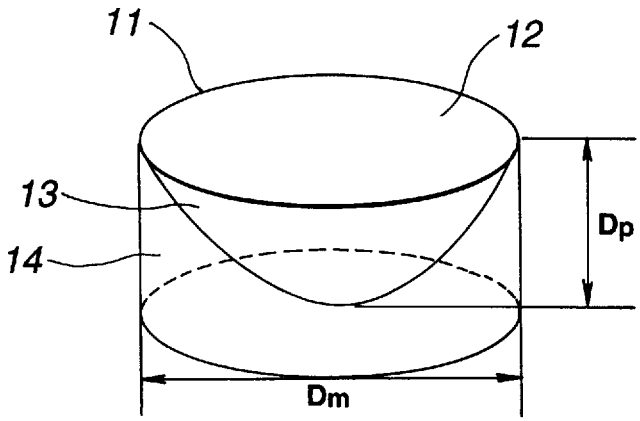
FIG. 3 is a perspective view of the same dimple.
Figure 4:
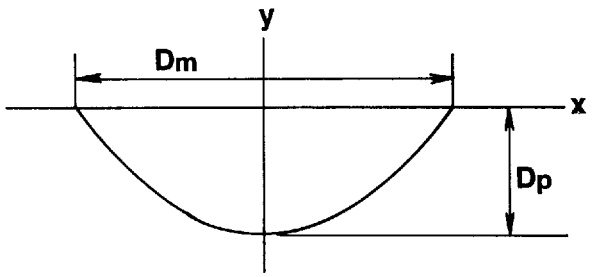
FIG. 4 is a cross-sectional view of the same dimple.

It is noted that $V_0$ is calculated as follows. In the event that the planar shape of a dimple is circular, as shown in FIG. 2, a phantom sphere 6 having the ball diameter and another phantom sphere 7 having a diameter smaller by 0.16 mm than the ball diameter are drawn in conjunction with a dimple 5. The circumference of the other sphere 7 intersects with the dimple 5 at a point 8. A tangent 9 at intersection 8 intersects with the phantom sphere 6 at a point 10 while a series of intersections 6 define a dimple edge 11. The dimple edge 11 is so defined for the reason that otherwise, the exact position of the dimple edge cannot be determined because the actual edge of the dimple 5 is rounded. The dimple edge 11 circumscribes a plane 12 (having a diameter Dm). Then as shown in FIGS. 3 and 4, the dimple space 13 located below the plane 12 has a volume Vp, which is determined from equation (4). A cylinder 14 whose bottom is the plane 12 and whose height is the maximum depth Dp of the dimple from the bottom or circular plane 12 has a volume Vq, which is determined from equation (5). The ratio $V_0$ of the dimple space volume Vp to the cylinder volume Vq is calculated according to equation (6).

$$Vp = \int_0^{\frac{Dm}{2}} 2\pi xy dx \tag{4}$$

$$Vq = \frac{\pi Dm^2 Dp}{4} \tag{5}$$

$$V_0 = \frac{Vp}{Vq} \tag{6}$$

In the event that the planar shape of a dimple is not circular, the maximum diameter or length of a dimple is determined, the plane projected shape of the dimple is assumed to be a circle having a diameter equal to this maximum diameter or length, and $V_0$ is calculated as above based on this assumption.

Thirdly, a percent dimple volume Vr given by the following equation (2) is preferably in the range of 0.8% to 1.2%, especially 0.85% to 1.1%

$$Vr = \frac{Vs}{\frac{4}{3}\pi R^3} \times 100 \tag{2}$$

wherein Vs is the sum of the volumes of dimple spaces each below a circular plane circumscribed by the dimple edge. Note that the spatial volume of one dimple is Vp defined above. R is a ball radius as defined above.

By setting the percent dimple area, dimple area index Dst, and percent dimple volume Vr in the above-defined ranges, the golf ball of the invention is given an appropriate dimple effect complying with the improved spin property mentioned above. This results in a further increased flight distance.

The total number of dimples is preferably 360 to 450, more preferably 372 to 432. There may be two or more types of dimples which are different in diameter and/or depth. It is preferred that the dimples have a diameter of 2.2 to 4.3 mm and a depth of 0.1 to 0.24 mm. The arrangement of dimples may be selected from regular octahedral, dodecahedral, and icosahedral arrangements as in conventional golf balls though not critical. Furthermore, the pattern formed by thus arranged dimples may be any of square, hexagon, pentagon, and triangle patterns.

While the three-piece solid golf ball of the invention is constructed as mentioned above, ball specifications including weight and diameter are properly determined in accordance with the Rules of Golf. Also the preparation method is not critical. The respective layers including the solid core 1, intermediate layer 2, and cover 3 may be formed by well-known methods, for example, compression molding and injection molding.

Since the relationship of specific gravity and hardness among the solid core, intermediate layer, and cover is optimized and the inertia moment of the ball as a whole is optimized, the three-piece solid golf ball of the invention offers improved spin property and the ease of control upon approach shots with a short iron without reducing the flight distance upon full shots with a driver or long iron. Also, the ball exhibits good rolling property on the green, that is, straight run. Additionally, the ball is fully durable in that it is not readily scuffed or scraped by shots.

EXAMPLE

Examples of the present invention are given below together with Comparative Examples by way of illustration and not by way of limitation.

EXAMPLES 1–5 AND COMPARATIVE EXAMPLES 1–3

Three-piece solid golf balls (Examples 1–5 and Comparative Examples 1–2) were produced by milling a rubber composition of the formulation shown in Table 1, molding and vulcanizing the composition to form a solid core having the specifications shown in Table 3. Using compositions of the formulation shown in Table 1, an intermediate layer and a cover having the specifications shown in Table 3 were successively injection molded around the solid core. At the same time as the last injection molding, dimples were indented in the cover surface in accordance with Table 2. A commercially available wound balata ball "The Rextar" by Bridgestone Sports Co., Ltd. was used as the wound golf ball of Comparative Example 3.

It is noted that the amounts of components in the core, intermediate layer, and cover as reported in Table 1 are all parts by weight and SG is specific gravity.

The golf balls were examined for inertia moment, flight performance, spin, feel, durability and rolling on the green by the following tests. The results are shown in Table 3.

Inertia moment

The diameter of the respective layers was an average of five measurements. As to the weight, the ball was disintegrated into the core, the intermediate layer, and the cover and these layers were individually measured for weight. From these measurements, the addition weight and volume were calculated and the specific gravity of the respective layers calculated therefrom. With respect to the cover, its phantom specific gravity was used as mentioned above. The inertia moment was calculated by substituting these values in the following equation.

$$MI = A \times \{(a-b) \times m^5 + (b-c) \times n^5 + c \times p^5\}$$

MI: inertia moment (g-cm$^2$)
A: constant, $\pi/5880000$
a: core specific gravity
b: intermediate layer specific gravity
c: phantom cover specific gravity
m: core diameter (mm)
n: intermediate layer diameter (mm)
p: ball diameter (mm)

Flight performance

Using a swing robot manufactured by True Temper Co., the ball was hit with a driver (#W1) at a head speed of 50 m/sec. (HS50) to measure a spin rate, carry and total distance.

Spin rate

Using the same swing robot as above, the ball was hit with a sand wedge (#SW) at a head speed of 25 m/sec. (HS25) to measure a spin rate and run.

Hitting feel

Three professional golfers actually hit the ball at a head speed of about 45 m/sec. (HS45) with a driver (#W1) and at a head speed of about 5 m/sec. (HS5) with a putter (#PT) to examine the ball for hitting feel according to the following criteria.

○: very soft feel

Δ: average

X: hard feel

Scuff resistance

Using the same swing robot as above, the ball was hit with a pitching wedge (#PW) at a head speed of 33 m/sec. (HS33). The ball at the hit point was visually observed how it was damaged.

○: no or substantially unperceivable flaw

X: perceivable flaw

Rolling

On the green, three professional golfers actually putted the ball with a putter (#PT). The ball was examined for rolling according to the following criterion.

○: straight and long-lasting rolling

X: not straight and not long-lasting

TABLE 1

| | E1 | E2 | E3 | E4 | E5 | CE1 | CE2 | CE3 |
|---|---|---|---|---|---|---|---|---|
| Core | | | | | | | | |
| Cis-1,4-poly-butadiene | 100 | 100 | 100 | 100 | 100 | 100 | 100 | liquid center |
| Zinc acrylate | 29.7 | 25.0 | 29.7 | 25.5 | 20.0 | 33.8 | 25.5 | |
| Dicumyl peroxide | 0.9 | 0.9 | 0.9 | 0.9 | 0.9 | 0.9 | 0.9 | |
| Antioxidant | 0.2 | 0.2 | 0.2 | 0.2 | 0.2 | 0.2 | 0.2 | |
| Zinc oxide | 5 | 5 | 5 | 5 | 5 | 5 | 5 | |
| Barium sulfate | 3.6 | 0.9 | 1.5 | 5.3 | 0.5 | 27.4 | 12.8 | |
| Intermediate layer | | | | | | | | |
| Himilan 1706 | 50 | 50 | 50 | 100 | 100 | 50 | 100 | — |
| Himilan 1605 | 50 | 50 | 50 | — | — | 50 | — | |
| Tungsten (SG 19.3) | — | 33.8 | — | — | 39.5 | — | 39.5 | |
| Barium sulfate (SG 4.45) | 28.4 | — | 34.5 | 31.4 | — | — | — | |
| Cover | | | | | | | | |
| Pandex EX7895 | 100 | 100 | 100 | — | — | — | — | Balata |
| Pandex T-7298 | — | — | — | 100 | 100 | — | — | |
| Surlyn 9320 | — | — | — | — | — | 20 | — | |
| Surlyn 8120 | — | — | — | — | — | 50 | — | |
| Himilan 1557 | — | — | — | — | — | 30 | — | |
| Himilan 1605 | — | — | — | — | — | — | 100 | |
| Titanium dioxide | 5.13 | 5.13 | 5.13 | 5.13 | 5.13 | 5.13 | 5.13 | |
| Magnesium stearate | 1.22 | 1.22 | 1.22 | 1.22 | 1.22 | 1.22 | 1.22 | |
| Ultramarine (coloring agent) | 0.03 | 0.03 | 0.03 | 0.03 | 0.03 | 0.03 | 0.03 | |

Note:

Pandex is a trade name of thermoplastic polyurethane elastomer by Dai-Nihon Ink Chemical Industry K.K.

Surlyn is a trade name of ionomer resin by E. I. duPont de Nemours Co.

Himilan is a trade name of ionomer resin by Mitsui duPont Polychemical K.K.

TABLE 2

| Dimple type | Diameter (mm) | Depth (mm) | $V_o$ | Number | % dimple area | Dimple area index Dst | Total dimple volume Vs ($mm^3$) | % dimple volume Vr |
|---|---|---|---|---|---|---|---|---|
| I | 4.100 | 0.225 | 0.520 | 54 | 68.7 | 4.305 | 83.414 | 1.13 |
| | 3.850 | 0.225 | 0.520 | 174 | | | 236.999 | |
| | 3.400 | 0.225 | 0.520 | 132 | | | 140.219 | |
| II | 4.150 | 0.225 | 0.490 | 54 | 70.3 | 4.148 | 80.530 | 1.09 |
| | 3.850 | 0.225 | 0.490 | 174 | | | 223.326 | |
| | 3.500 | 0.225 | 0.490 | 132 | | | 140.016 | |

TABLE 3

| | Example | | | | | Comparative Example | | |
|---|---|---|---|---|---|---|---|---|
| | 1 | 2 | 3 | 4 | 5 | 1 | 2 | 3 |
| Core | | | | | | | | |
| Weight (g) | 25.57 | 24.86 | 25.29 | 27.71 | 25.69 | 31.40 | 28.85 | commercial wound balata ball*3 |
| Diameter (mm) | 35.5 | 35.5 | 35.5 | 36.5 | 36.1 | 36.5 | 36.5 | |
| Hardness*1 (mm) | 3.30 | 4.30 | 3.30 | 4.20 | 5.40 | 2.40 | 4.20 | |
| Specific gravity | 1.091 | 1.061 | 1.079 | 1.089 | 1.043 | 1.233 | 1.133 | |
| Intermediate layer | | | | | | | | |
| Hardness (Shore D) | 65 | 65 | 65 | 63 | 63 | 65 | 63 | |
| Weight (g) | 33.66 | 33.66 | 33.66 | 33.26 | 33.26 | 38.34 | 38.34 | |
| Diameter*2 (mm) | 38.75 | 38.75 | 28.75 | 39.70 | 39.70 | 39.70 | 39.70 | |
| Specific gravity | 1.15 | 1.25 | 1.19 | 1.17 | 1.30 | 0.95 | 1.30 | |
| Gage (mm) | 1.63 | 1.63 | 1.63 | 1.60 | 1.80 | 1.60 | 1.60 | |
| Cover | | | | | | | | |
| Hardness (Shore D) | 45 | 45 | 45 | 50 | 50 | 48 | 67 | |
| Specific gravity | 1.20 | 1.20 | 1.20 | 1.20 | 1.20 | 0.97 | 0.97 | |
| Gage (mm) | 1.98 | 1.98 | 1.98 | 1.50 | 1.50 | 1.50 | 1.50 | |
| Phantom specific gravity | 1.13 | 1.13 | 1.13 | 1.13 | 1.13 | 0.87 | 0.87 | |
| Hardness difference between cover and intermediate layer | 20 | 20 | 20 | 13 | 13 | 17 | −4 | |
| Ball | | | | | | | | |
| Weight (g) | 45.3 | 45.3 | 45.3 | 45.3 | 45.3 | 45.3 | 45.3 | |
| Diameter (mm) | 42.7 | 42.7 | 42.7 | 42.7 | 42.7 | 42.7 | 42.7 | |
| Dimple type | I | I | II | II | II | I | II | |

TABLE 3-continued

| | Example | | | | | Comparative Example | | |
|---|---|---|---|---|---|---|---|---|
| | 1 | 2 | 3 | 4 | 5 | 1 | 2 | 3 |
| Inertia moment (g-cm$^2$) | 84.9 | 85.6 | 85.2 | 85.0 | 86.2 | 80.0 | 82.9 | |
| #W1/HS50 | | | | | | | | |
| Spin (rpm) | 2730 | 2710 | 2750 | 2630 | 2560 | 2900 | 2470 | 3120 |
| Carry (m) | 235.0 | 234.6 | 235.1 | 235.4 | 235.0 | 232.0 | 235.5 | 230.1 |
| Total (m) | 250.7 | 250.5 | 250.9 | 251.2 | 250.9 | 247.2 | 251.3 | 245.0 |
| #SW/HS25 | | | | | | | | |
| Spin (rpm) | 8230 | 8170 | 8200 | 8070 | 8050 | 8100 | 5610 | 8220 |
| Run (m) | 0.8 | 1.1 | 1.0 | 1.3 | 1.4 | 2.3 | 4.5 | 2.2 |
| Feel | | | | | | | | |
| #W1/HS45 | ○ | ○ | ○ | ○ | ○ | X | Δ | ○ |
| #PT/HS5 | ○ | ○ | ○ | ○ | ○ | Δ | X | ○ |
| Scuff resistance | ○ | ○ | ○ | ○ | ○ | X | ○ | X |
| #PW/HS33 | | | | | | | | |
| Rolling | ○ | ○ | ○ | ○ | ○ | X | ○ | X |
| #PT | | | | | | | | |

*1a distortion (mm) of a ball under an applied load of 100 kg
*2a diameter of a sphere consisting of core plus intermediate layer
*3The Rexter by Bridgestone Sports Co., Ltd.

As is evident from Table 3, the golf balls within the scope of the invention are excellent in all the factors of flight distance, spin control, feel, scuff resistance, and rolling. In contrast, the golf ball of Comparative Example 1 gives an unpleasant feel on #W1 shot owing to a higher core hardness, stalls at the end of its trajectory owing to a lower inertia moment, travels short, and is susceptible to scuff flaw and less durable. The golf ball of Comparative Example 2 shows poor spin property and poor feel on putting owing to a harder cover. The wound golf ball of Comparative Example 3 follows a lofting and non-extending trajectory owing to an increased spin rate with #W1 and a low inertia moment, travels short, and is susceptible to scuff flaw and less durable.

Japanese Patent Application No. 329230/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A three-piece solid golf ball of the three layer structure consisting of a solid core, an intermediate layer, and a cover, wherein the specific gravity of said solid core is lower than the specific gravity of said intermediate layer and said cover, the Shore D hardness of said intermediate layer is higher than the Shore D hardness of said cover, and the ball as a whole has an inertia moment of at least 83 g-cm$^2$.

2. The three-piece solid golf ball of claim 1 wherein the Shore D hardness of said intermediate layer is at least 10 degrees higher than the Shore D hardness of said cover.

3. The three-piece solid golf ball of claim 1 wherein said solid core has a specific gravity of 1.0 to 1.1 and a distortion of at least 2.5 mm under a load of 100 kg.

4. The three-piece solid golf ball of claim 1 wherein said intermediate layer has a Shore D hardness of 55 to 70 and a specific gravity of 1.1 to 1.6.

5. The three-piece solid golf ball of claim 1 wherein said cover has a Shore D hardness of 35 to 55 and a specific gravity of 1.1 to 1.3.

6. The three-piece solid golf ball of claim 1 having at least two types of dimples in the ball surface wherein an index (Dst) of overall dimple surface area given by the following expression (1) is at least 4, $$Dst = \frac{n \sum_{k=1}^{n} [(Dmk^2 + Dpk^2)\, xV_0kxNk]}{4R^2} \quad (1)$$

wherein R is a ball radius, n is the number of dimple types ($n \geqq 2$), Dmk is a diameter of dimples k, Dpk is a depth of dimples k, Nk is the number of dimples k wherein k=1, 2, 3, . . . n, and $V_0$ is the volume of one dimple space below a plane circumscribed by the dimple edge divided by the volume of a cylinder whose bottom is the plane and whose height is the maximum depth of the dimple from the bottom, provided that the golf ball is a complete sphere defining a phantom spherical surface, a percent dimple area which is the total of the surface areas on the phantom spherical surface circumscribed by the edge of individual dimples divided by the overall surface area of the phantom spherical surface is at least 63%, a percent dimple volume Vr given by the following equation (2) is in the range of $0.8\% \leqq Vr \leqq 1.2\%$, $$Vr = \frac{Vs}{\frac{4}{3}\pi R^3} \times 100 \quad (2)$$

wherein Vs is the sum of the volumes of dimple spaces each below a circular plane circumscribed by the dimple edge and R is a ball radius.

7. The three-piece solid golf ball of claim 1 wherein said cover is mainly formed of a thermoplastic polyurethane elastomer.

* * * * *